US005687432A

United States Patent [19]

Genzel

[11] Patent Number: 5,687,432

[45] Date of Patent: Nov. 18, 1997

[54] PORTABLE FRAME COMPRISED OF INTERLOCKING FLEXIBLE RIBS

[76] Inventor: Charles C. J. Genzel, P.O. Box 34, West Davenport, N.Y. 13860

[21] Appl. No.: 589,646

[22] Filed: Jan. 22, 1996

Related U.S. Application Data

[63] Continuation of Ser. No. 298,134, Aug. 30, 1994, abandoned.

[51] Int. Cl.[6] ..... E04H 4/08

[52] U.S. Cl. ..... 4/498; 4/498

[58] Field of Search ..... 4/498, 503

[56] References Cited

U.S. PATENT DOCUMENTS

| | | | |
|---|---|---|---|
| Re. 30,774 | 10/1981 | Dahlback et al. | 4/503 X |
| 3,475,768 | 11/1969 | Burton | 4/498 X |
| 3,683,427 | 8/1972 | Burkholz et al. | 4/503 X |
| 3,766,573 | 10/1973 | Burkholz et al. | 4/498 |
| 4,257,132 | 3/1981 | Kerby | 4/503 X |
| 4,951,327 | 8/1990 | Del Gorio | 4/503 X |
| 5,371,907 | 12/1994 | Horvath | 4/498 |
| 5,381,634 | 1/1995 | Pietrogrande | 4/503 X |

*Primary Examiner*—Charles E. Philips

[57] ABSTRACT

A lightweight frame capable of being hand-assembled and particularly adapted for supporting a cover sheet over a pool or spa, or for providing a temporary shelter. The frame includes at least one central hub having a plurality of ribs extending from the hub to the edge of the pool or spa. Each rib includes a plurality of segments that are connected end-to-end, there being an end member which holds the rib against the edge of the pool or spa. The frame is generally dome shaped above the pool or spa and held in place by forces extending along the length of the ribs toward the edge of the pool or spa. When used as a temporary shelter, the end members include pointed portions that can be inserted into the ground. The end members can include portions to which a cover sheet placed over the frame can be fastened in order to secure the cover sheet. The frame can include any number of segments depending upon the ultimate size desired, the height of the frame being dependent upon the length of the ribs. If the ribs are flexible, a dome shape can be achieved. As an alternative, the ribs can be straight rather than bowed.

14 Claims, 3 Drawing Sheets

PORTABLE FRAME COMPRISED OF INTERLOCKING FLEXIBLE RIBS

This is a continuation of application Ser. No. 08/298,134, filed Aug. 30, 1994 abandoned.

FIELD OF THE INVENTION

This invention relates to a portable frame comprised of a plurality of flexible ribs each of which is joined at one end to at least one central hub and at the other end to a peripheral member that is adapted to butt against the edge of a pool or spa or is adapted to be inserted into the ground, and more particularly to such a frame that can be used to support a cover sheet, or sheets, in order to provide a pool or spa cover or a temporary shelter.

BACKGROUND ART

Swimming pool covers are well known and various designs have been proposed, many of which use air compartments to provide a convex shape above the pool. Still other designs use complicated and heavy metal frames for this purpose. Generally, it is desired to have the pool cover bow outwardly so as to provide a crown for shedding debris, etc. that would collect on the pool cover. This prevents sagging of the cover to optimally keep debris from entering the pool. Many of the frame-type pool covers utilize a frame comprised of individual members that are tubular in order to allow them to be filled with air and therefore be floatable on the surface of the pool water. Examples of such frames are shown in U.S. Pat. Nos. 3,184,763 and 4,577,352. In the first of these, the tubular frame is made of members that will sink when the air is let out of the tubes, causing the pool cover to sink to the bottom of the pool. This frame is made of hollow tube members which generally do not connect to one another. That is, the longitudinal members 20 do not interconnect with the lateral members 21.

The cover of U.S. Pat. No. 4,577,352 is comprised of various extruded segments having hollow compartments where adjacent segments can be coupled to one another. Plugs are provided at the ends of the various segments to trap air therein. In this cover, the segments themselves provide the pool cover, there being no need for a canvas sheet over the extruded segments.

Additional examples of the use of buoyant tubes to provide a pool cover are found in French patent publications 2561699 and 2544213. In the former, an inflatable pool cover is provided by tubes which are connected at their sides by bracing bands. The combination of inflatable tubes and bands becomes the cover, and is inflated when in use over the pool.

U.S. Pat. No. 4,000,749 describes an isolation shelter including a tent-like frame from which inflatable sections are suspended to provide the shelter. The outer ends of the poles 34 forming the tent-like frame are pointed for insertion into the ground.

Another type of swimming pool cover utilizing a floating support frame is described in U.S. Pat. No. 4,000,527. While this frame can comprise tubular, air-inflated bladders, it also describes the use of floating elements that can be made of materials such as foam and hollow plastic in order to provide the floating characteristic. These elements can be linked together using strings and eyelets, and attach to the edge of the pool using further strings and eyelets. A cover lays down over the floating frame and is attached to the edge of the pool.

These various types of inflatable pool covers are often difficult to use and subject to problems if there is air loss in any of the compartments. Further, they are often difficult to adjust to provide the proper dome shape over the pool in order to prevent the collection of debris and water on the cover.

Prior art frame-type pool covers also have problems, particularly those which rely on the use of inflatable tubes to support the cover. If there is an air leak in any of the inflatable tubes, the cover will exhibit a concave region in which water and debris can collect. Frame-type covers using more heavy elements are often difficult to assemble, particularly those which use very long segments to completely cross a pool's width or extend the length of a pool. These frames are also very difficult to adapt, if at all possible, to different shape pools. Instead, one is forced to purchase a new frame cover each time a different shape pool or different size pool is to be covered.

Accordingly, it is an object of the present invention to provide a low cost and lightweight pool cover which can be readily adapted to pools of any size or shape.

It is another object of this invention to provide a frame which can be fabricated to have any size or shape depending upon the pool or spa to be covered.

It is another object of this invention to provide an improved lightweight portable frame that is assembled by the user and which can be used to cover a pool or spa, or to make a temporary shelter.

It is another object of this invention to provide a lightweight, portable frame that can be used to easily support a cover sheet of the type used to protect a pool or spa, or to provide a protected enclosure.

It is another object of this invention to provide a frame that can support a cover where the frame includes a plurality of ribs comprised of individual segments that are easily joined together to provide ribs of any length, the ribs being connectable at one end thereof to a central hub and at the opposite ends thereof to the edge of the region over which the frame is to extend.

It is another object of this invention to provide a frame for extending over a pool, where the frame is comprised of individual flexible ribs comprised of segments that are easily joined, the frame providing a natural dome shape above the pool to be covered.

It is another object of this invention to provide a frame for supporting a pool cover, where the frame is made from a plurality of individual segments, none of which has a length that will extend across the pool width or across the pool length, or the entire diameter of the pool.

BRIEF SUMMARY OF THE INVENTION

The portable frame of this invention is generally comprised of at least one central hub having a plurality of generally flexible ribs extending therefrom to the edge of a pool or spa. In another embodiment, the ends of the ribs remote from the central hub can rest against, or into the ground in order to provide a frame for a temporary shelter.

Each of the ribs is comprised of a plurality of interlocking segments joined end-to-end, where any number of segments can be joined to provide a rib having the desired length. The segments have a plurality of different lengths, and in addition telescopic segments are provided in order to fine tune the length of a rib. The segments attach to one another in an end-to-end fashion, and are easily separated from one another during disassembly. The final rib structure is sufficiently flexible that a dome shape can be formed over the pool or spa in order to provide the proper shape for preventing collection of debris or water over the pool or spa.

The ends of the ribs remote from the central hub are connected to end members particularly adapted for abutting the edge of a pool or spa, or for being placed against or into the ground. These end members can be used whether the pool is an in-ground pool, or an above-the-ground pool.

For large pools or spas, extra strength is provided by reinforcing members which easily snap onto adjacent ribs in a direction transverse to the length of the ribs. These reinforcing members are easily snapped away from the ribs during disassembly of the frame.

In a preferred embodiment, the end members have tie-down cleats thereon so that a cover sheet (canvas, etc.) placed over the frame can be fastened to the frame to prevent it from being displaced by the wind or rain.

In operation, the frame is assembled and placed over the pool or spa, after which the pool or spa cover, typically a canvas, plastic, or rubber sheet, is placed over the frame and attached thereto. When a temporary shelter is to be provided, the end members of the frame are rested against the ground or are inserted into the ground (using pointed spikes on the end members) in order to secure the ribs.

The individual segments that are formed into ribs are typically made of a lightweight material, such as plastic, and can be solid except at the ends where they are to be joined to other segments to complete the final rib structure. Various types of removable interconnections can be used to join and separate the individual segments.

These and other objects, features and advantages will be apparent from the more particular description of the preferred embodiment.

DETAILED DESCRIPTION OF THE PREFERRED EMBODIMENTS

Figure 1:
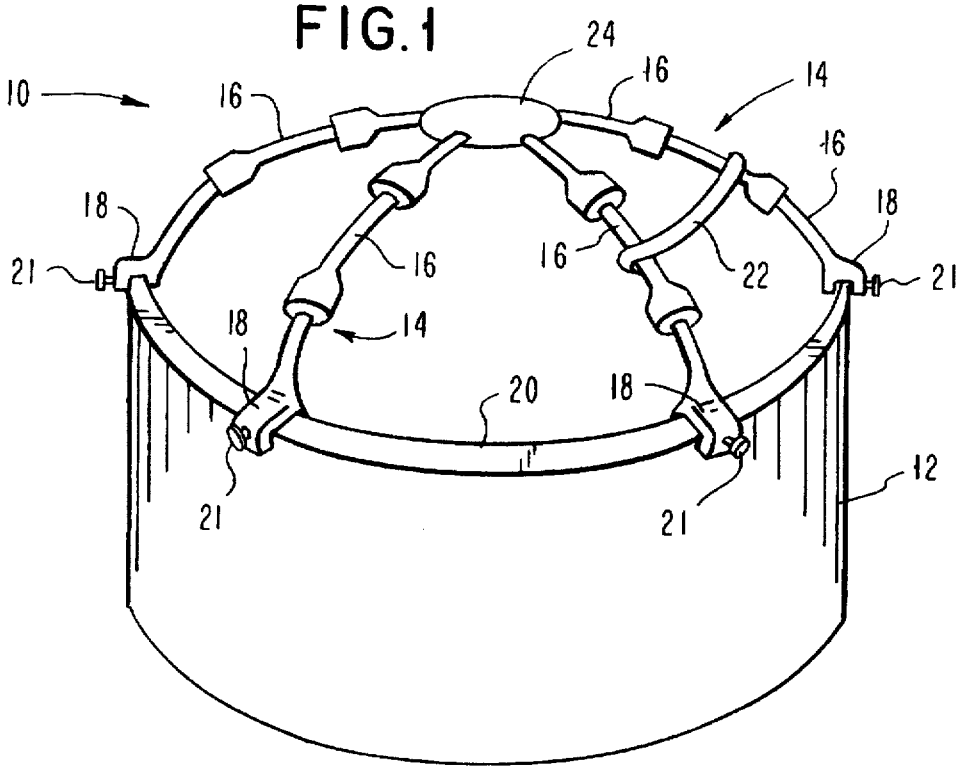
FIG. 1 is a side view of a swimming pool having the portable frame of this invention over the surface of the pool.

FIG. 1 is a side view of a pool or spa having a portable frame 10 thereover. Although not shown in this drawing, a cover sheet can be placed over frame 10 to provide protection of the pool or spa. Frame 10 provides a bowed, dome shape over pool or spa 12 because the individual ribs 14 are made from connectable segments 16 in a manner such that the entire rib 14 is somewhat flexible. Ribs 14 mate with end members 18 that contact the edge 20 of the pool or spa in such a manner that they will be firmly pressed against the edge 20 when the frame is in place above the pool or spa 12. Adjustment screws 21 can be used for this purpose, as will be more clearly shown in FIGS. 4A and 4B. In order to provide additional strength and lateral support to the portable frame 10, a plurality of reinforcing bands 22 are used. These bands snap onto adjacent ribs and are sufficiently rigid that they prevent the ribs from moving in directions transverse to their length.

A central hub 24 is located at the center of portable frame 10, into which the ends of the ribs remote from the pool or spa edge are inserted and held. As will be more apparent, the rib ends can be press fit into central hub 24 or a removable attachment of the type (male-female interconnect) shown in FIG. 3 can be used.

Figure 2:
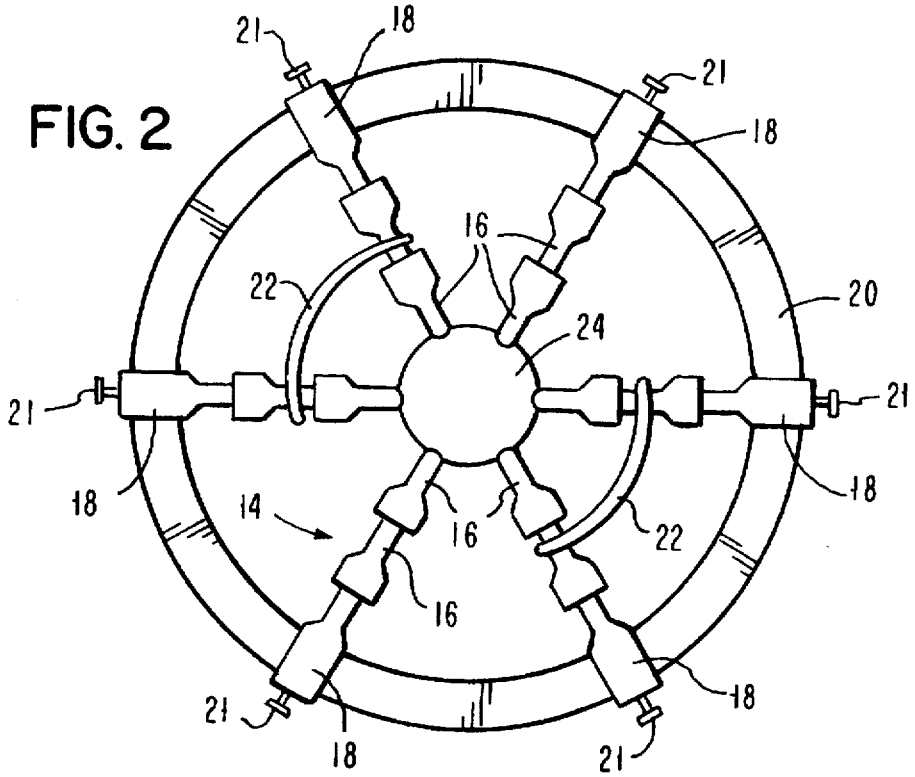
FIG. 2 is a top view of the swimming pool and frame shown in FIG. 1.

In FIGS. 1 and 2, each rib 14 is comprised of two segments 16 and an end member 18. It will be appreciated that the lengths of the individual ribs 14 are chosen with respect to the size of the pool or spa to be covered so that the number of interconnected segments 16 in each rib may vary. This will also depend on the available lengths of segments 16, where the segments can be provided in standard sizes of, for example, 5, 4, 3, 2, 1 feet. Further, it will be appreciated that the central hub 24 can have various shapes and sizes to accommodate various numbers of ribs in accordance with the size of the pool or spa to be covered.

Rib segments 16A and 16B (FIG. 3) illustrate how these segments removably interlock with one another. The rib segments are made of lightweight material, such as plastic or lightweight metals, and can have various cross-sectional shapes. An elliptical shape in which one axis of the ellipse is about 2 inches and the other about ¾ of an inch is quite suitable. Of course, rib segments 16 can be circular, rectangular or square in cross-sectional shape. Typically, the rib segments 16 are solid for most of their length except on the ends thereof where another rib segment 16 is to be inserted for interconnecting the segments.

Figure 3:
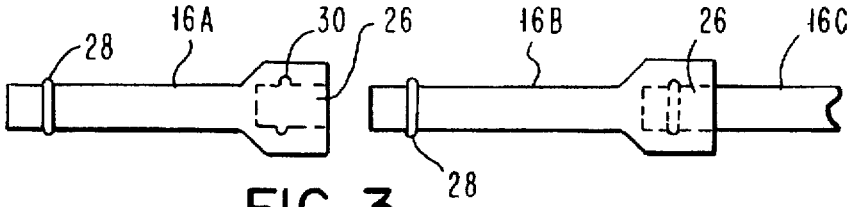
FIG. 3 illustrates a portion of the flexible ribs used to form the portable frame, showing how the various segments of the ribs interconnect with one another.

In one embodiment, each rib segment, illustrated by segments 16A and 16B, has a hollow end into which the adjacent rib segment can be inserted, and a solid end that can be inserted into the hollow portion of the next rib segment. In FIG. 3, segment 16A includes a hollow portion 26 in which the left end of rib segment 16B can be inserted. Rod 16B includes a protruding nipple portion 28 that fits into a corresponding groove 30 in the hollow portion 26 of segment 16A. The amount of overlap of segment 16A and segment 16B is generally 2–3 inches, although this can be increased if very long segments are to be interconnected. The amount of overlap is chosen with respect to the degree of rigidity and strength that is needed, as well as with respect to the amount of bowing that is to be provided. As the frame becomes more convex above the pool or spa, most of the forces on the ribs 14 will be along their length, and for this reason a lesser overlap may be sufficient. For frames that are not greatly bowed above the pool or spa, a greater overlap (for example, 5–6 inches) may be desirable.

If standard size segments are made to accommodate different amounts of overlap, then the desired total length of a rib 14 can be easily obtained.

For example, some 3 foot segments can be made to accommodate a 3 inch overlap, while other 3 foot segments can be made to accommodate a 6 inch overlap. Depending on which rib segments 16 are chosen, the total rib length for a given number of segments can be optimized.

In FIG. 3, the left end of segment 16A has the protruding nipple portion 28 to allow it to be inserted into an adjacent rib segment, while the right end of rib segment 16B includes a hollow region 26 for receipt of another rib segment 16C, shown here in an interlocking position in recess 26 of segment 16B.

While a suitable interlocking mechanism is provided in the manner shown with respect to the rib segments of FIG. 3, it is possible to use other types of removable interlocks for securing the rib segments to one another. For example, ball bearing detent attachments of the type used in the electrical arts and for removably connecting pneumatic air lines can also be used to removably connect the rib segments. Another coupling mechanism is a screw type one in which the ends of the segments are threaded. Different types of connectors can be chosen to allow easy attachment of the rib segments to one another and easy removal when dismantling the frame 10. Generally, mechanisms that allow the segments to be rapidly inserted and removed in a "snap-lock" type of coupling are preferable.

Figure 4A:
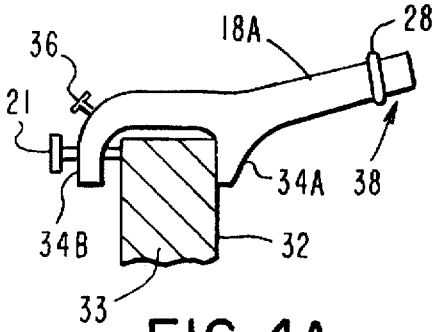
FIG. 4A shows an end member of a rib that can be used to secure the frame to an edge of an above-ground pool or spa.
Figure 4B:
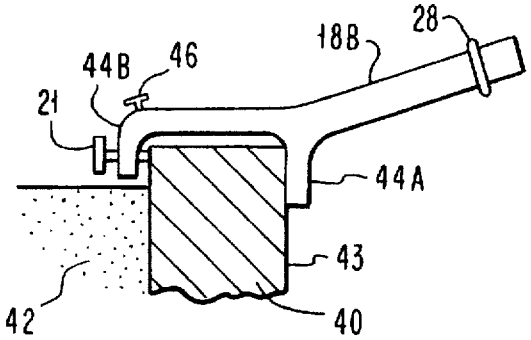
FIG. 4B shows an end member of a rib that can be used to secure the portable frame to an edge of an in-ground pool.
Figure 4C:
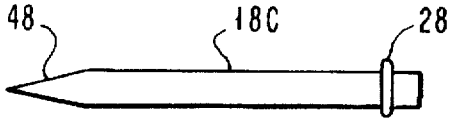
FIG. 4C shows an end member of a rib that can be used to insert a rib into the ground for use in providing a temporary shelter.

FIGS. 4A, 4B and 4C show various types of end members 18 that can be used in accordance with different applications of the portable frame 10. In FIG. 4A, end member 18A is shown in contact with the inner edge 32 of the side wall 33 of an above-ground pool or spa. End member 18A includes two extending portions 34A and 34B that are located on opposite sides of the edge 32. In use, end member 18A will rest on and against edge 32 due to the forces exerted along the ribs 14 pressing outwardly from the central hub toward the edge 32. Adjustment screw 21 ensures a tight fit against inner edge 32 and allows end member 18A to be used with side walls 33 having different widths.

Portion 34B is usually longer than portion 34A, and includes a tie-down cleat 36 to which an overlying pool or spa cover sheet can be secured. Rather than a tie-down cleat 36, another type of structure, such as an opening in portion 34B, can be provided for tying a cover sheet (placed over frame 10) to the frame. By having portion 34B extended in length, it is ensured that the cleat 36 will be sufficiently past the edge of the pool or spa that the cover sheet placed on the frame will also extend beyond the edge of the pool or spa. In turn, this ensures that no water or debris will enter the pool or spa.

The end 38 of member 18A remote from edge 32 is adapted for mating with a rib segment 16. It can therefore have a hollow portion 26 (not shown) or a solid portion with nipple 28 (shown) depending upon how the mating is to occur.

FIG. 4B shows an end member 18B particularly adapted for use with an in-ground pool. In this type of pool, the side wall 40 does not protrude much above ground 42, which necessitates a slightly different shape to provide the cover sheet tie-down. Accordingly, end member 18B includes a first portion 44A that abuts the inner edge 43 of side wall 40 and a longer portion 44B that extends a short distance over the ground 42. Adjustment screw 21 is used to provide a secure contact of portion 44A against the inner edge 43. A tie-down cleat 46 is located beyond the edge 40 of the pool. Similarly as with the end member of FIG. 4A, tie-down cleat 46 could be replaced by other structure in order to be able to fasten a cover sheet placed over frame 10 to the frame itself. Because portion 44B extends beyond the edge of the pool, the entire pool will be covered when the sheet is attached to cleat 46.

End members 18A and 18B can be designed to be generally straight (i.e., parallel to the rib length) or angled slightly in order to be oriented approximately normal to the edge of the pool or spa when adjusted to press tightly against the inner edge (32 or 43). Because the overall effect of all the ribs is to press against the inner edge of the side wall of the pool or spa, good stability will result even if the end members don't make full contact with the inner edge 32 or 43 along the entire width of portions 34A and 44A, respectively.

FIG. 4C shows an end member 18C having a pointed tip 48 that can be inserted in the ground. This type of end member is adapted for use when the frame 10 is to provide a temporary shelter. In this situation, pointed tip 48 is inserted into the ground and the ribs 14 provide a domed structure that can then be covered by a sheet in order to provide a tent-like enclosure.

As with end member 18A, the ends of members 18B and 18C remote from the pool edge or ground are adapted for mating with a rib segment 16.

Figure 5:
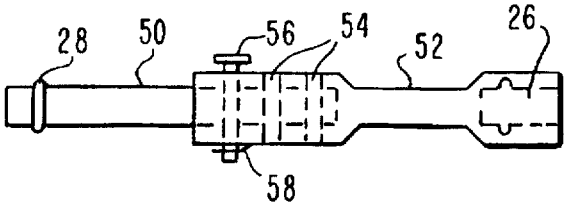
FIG. 5 illustrates a telescopic rib segment that is adjustable to provide various lengths.

FIG. 5 illustrates an adjustable rib segment 16C. While most standard size pools or spas can easily be constructed using combinations of rib segments 16 of various standard lengths, in rare circumstances it may be necessary to provide a rib segment that is adjustable in length in order to accommodate irregular shape pools or spas. Accordingly, telescopic rib segment 16C includes a first inner portion 50 and a second outer (sleeve) portion 52 into which inner portion 50 can be inserted. A plurality of openings 54 are provided in both inner portion 50 and outer portion 52. In use, portion 50 is inserted the required overlap distance into portion 52 and held in place therein by a pin 56. The pin can have a clip 58 on one end thereof to ensure that it will not slip out of the openings 54. As a variation the mating ends of portions 50 and 52 can be threaded, so the degree of overlap will depend on how far portion 50 is screwed into portion 52.

Adjustable rib segment 16C is provided with the usual mating adaptations on each end. Thus, the right hand end of portion 52 includes the opening 26 while the left hand end of portion 50 includes the protruding nipple 28.

Because the completed ribs have flexibility, the exact length of a rib is generally not critical as long as the ribs reach from the edge of the pool or spa to the central hub. If the ribs are long the height above the pool or spa will be greater, while if the ribs are shorter, the height of the frame above the pool or spa will be less.

Figure 6A:
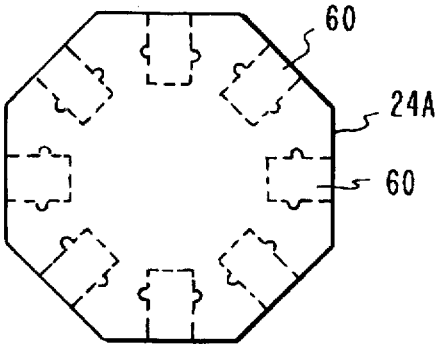
FIG. 6A illustrates one embodiment for a central hub into which the ribs of the frame are inserted.
Figure 6B:
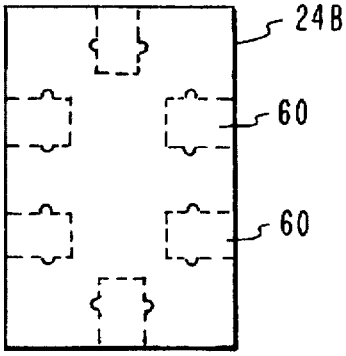
FIG. 6B illustrates another central hub having a shape that is more suitable for use with a rectangular pool or spa.

FIGS. 6A and 6B show different shaped central hubs. In FIG. 6A the central hub 24A is octagonal in shape while in FIG. 6B the central hub 24B is rectangular. Each of these central hubs has a plurality of openings 60 therein into which the male ends of rib segments 16 can be inserted. Rib segments 16 can mate with openings 60 in the same manner as that shown for the interconnection of adjacent rib segments 16A and 16B in FIG. 3. Thus, as an alternative, the openings 60 can be replaced by male connectors that are inserted into female connectors on the ribs.

Central hub 24A can also have a circular or elliptical shape. Whether it is octagonal, circular or elliptical, it is generally most suitable for use with a circular or elliptical pool or spa. The central hub 24B can also be square, and whether rectangular or square, is more suitable for use with a rectangular or square pool or spa. Of course, it will be appreciated that central hubs 24A and 24B may also be interchanged in use, i.e., used with differently shaped pools or spas. Thus, a circular or octagonal central hub can also be used with a rectangular or square pool or spa.

Figure 7A:
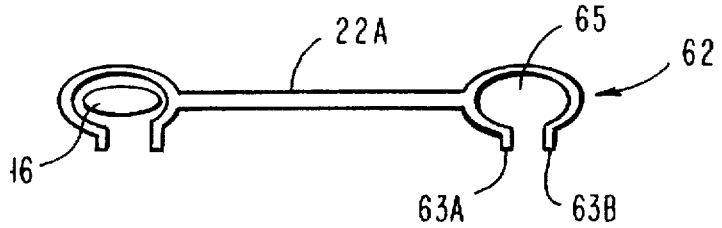
FIG. 7A illustrates a straight reinforcing band that can be easily snapped onto adjacent ribs of the portable frame of this invention.
Figure 7B:
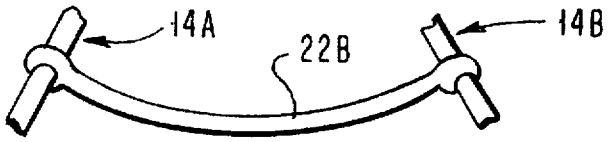
FIG. 7B illustrates a curved reinforcing band that is suitable for use in a frame covering a circular pool or spa.

FIGS. 7A and 7B illustrate two types of reinforcing bands 22. In FIG. 7A the reinforcing band 22A is a straight band, while in FIG. 7B the reinforcing band 22B is curved. The shape of the reinforcing band 22 is chosen in accordance with the relative positions of the ribs 14 in the frame. For example, where the ribs 14 extend radially outward over the pool or spa as shown in FIGS. 1 and 2, curved reinforcing bands 22B are most suitable. For a square or rectangular pool in which central hub 24B (FIG. 6B) is chosen, a straight reinforcing band 22A is used.

Reinforcing bands 22A and 22B include curved end portions 62 that are adapted to snap onto the central regions of the ribs 16. While portions 62 are shown as having generally elliptical shapes in order to snap onto rib segments 16 of generally elliptical cross-section, it will be appreciated that portion 62 will have a shape to allow it to be snapped onto a correspondingly shaped rib segment. As an example, if the rib segments have a square or circular cross-section, end portion 62 of the reinforcing bands would have a square or circular cross-section to allow them to snap onto the square rib segments. The curved end portions 62 include first and second opposing parts 63A, 63B that will separate slightly when pressed onto a rib segment. This will allow the rib segment to "pop" into the central opening 65 where it is then held. FIG. 7A illustrates the position of the reinforcing band 22A in relation to the rib segment 16, when in place on the frame. FIG. 7B illustrates a curved band 22B snapped onto ribs 14A and 14B.

Figure 8A:
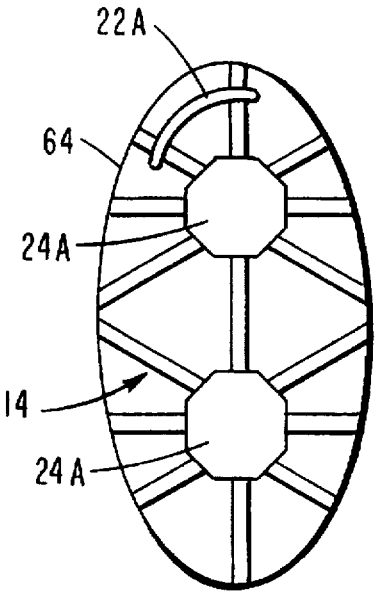
FIG. 8A is a top view of a frame in accordance with this invention where two central hubs are utilized, the pool having an elliptical shape in this drawing.
Figure 8B:
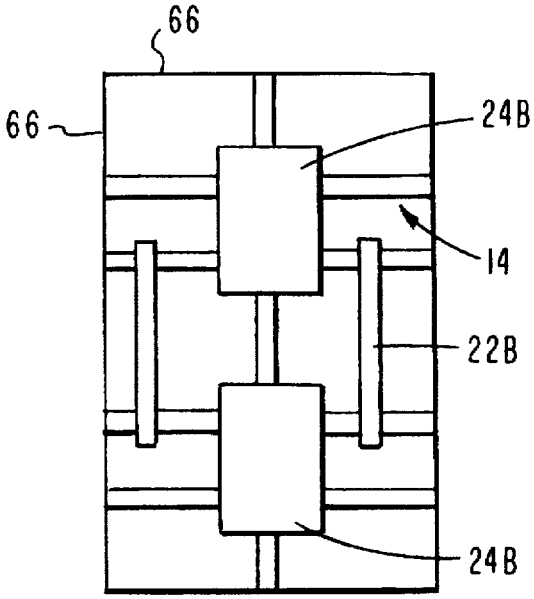
FIG. 8B illustrates a top view of a portable frame over a rectangular pool, where two interconnected hubs are utilized.

FIGS. 8A and 8B are top views of frames covering an elliptical pool or spa and a rectangular pool or spa, respectively. These views illustrate frames using multiple central hubs with the ribs 14 extending therefrom.

In FIG. 8A, the portable frame includes two interconnected central hubs 24A from which ribs 14 radially extend to the edge 64 of the pool or spa. In this frame, curved reinforcing bands such as 22B are used.

In FIG. 8B, two rectangular central hubs 24B are used, where the ribs 14 extend in directions perpendicular to or parallel to the edges 66 of the pool or spa. In this frame, straight reinforcing bands 22A are used.

In FIGS. 8A and 8B the central hubs are interconnected by a rib that has a length dependent upon the separation of the central hubs. For very large pools or spas, it can be envisioned that more than two central hubs will be used, or the central hubs can be very large in size. Further, it will be appreciated that the frames of FIGS. 8A and 8B can be used to provide a temporary shelter, rather than being used to cover a pool or spa.

What has been described is a portable frame having many applications, but uniquely an application for providing a pool or spa cover. The frame is comprised of lightweight rib segments that can be removably interconnected to provide ribs of any length, one end of the ribs being held in a central hub and the other being used to contact the edge of a pool or spa, or being inserted into the ground. The structure is extremely simple and lightweight and is easily usable by individuals.

While the invention has been shown with respect to particular embodiments thereof, it will apparent to those of skill in the art that variations can be made therein without departing from the spirit and scope of the present invention, which is to be limited only by the claims issuing thereon.

I claim:

1. A frame for supporting a pool or spa cover sheet, said frame extending above said pool or spa and including:

at least one central hub positioned above said pool or spa and having a plurality of locations therein to which ribs can be removably held, a plurality of flexible ribs extending from said central hub to the edge of said pool or spa, said ribs including removably interlocking segments connected end-to-end in a snap-lock manner, said segments having at one end thereof a portion where another segment can be inserted for joining said segments in end-to-end fashion, the joined ends of said segments including protruding and recessed portions that snap-lock to have said segments interlock when joined, end members having a first portion connected to the ends of said ribs remote from said central hub and a second portion being adapted to conform to the contour of the edge of said pool or spa and to rigidly abut against said edge to secure said frame thereagainst, said end members providing a portion of the length of said ribs, said frame being flexed and dome-shaped when in place over said pool or spa, the highest portion of said frame above said pool being said at least one central hub, said frame being held securely in place by forces between said rib segments when said ribs are flexed between the edge of said pool or spa and said central hub.

2. The frame of claim 1, including a plurality of said central hubs that are removably connected to one another.

3. The frame of claim 1, where at least two segments of each rib are of different lengths.

4. The frame of claim 1, further including reinforcing bands removably held to adjacent ribs, said reinforcing bands including means at each end thereof that can be snap-fit onto said adjacent ribs, said reinforcing bands extending transversely to the length of said ribs.

5. The frame of claim 1, where at least one of said ribs includes a segment whose length can be adjusted.

6. The frame of claim 1, where said end members have portions thereof to which said pool or spa cover sheet can be fastened.

7. The frame of claim 1, where said ribs have sufficient flexibility to allow said frame to be dome shaped above said pool or spa.

8. The frame of claim 1, where said ribs extend radially outward from said central hub to the edges of said pool or spa.

9. The frame of claim 1, where said segments have a generally solid cross section.

10. The frame of claim 1, where each said segment has a recessed portion at one end thereof where the end of another segment can be inserted for joining the segments.

11. The frame of claim 1, where each segment includes a male connector at one end thereof and a female connector at the other end thereof.

12. The frame of claim 1, where said ribs extend from said central hub in directions substantially transverse to the length of said pool or spa.

13. The frame of claim 1, where said end members include portions to which a cover sheet placed over said frame can be secured.

14. The frame of claim 1, further including a cover sheet laying over said frame and removably attached thereto.

* * * * *